US006902876B2

(12) United States Patent
Yanata

(10) Patent No.: US 6,902,876 B2
(45) Date of Patent: Jun. 7, 2005

(54) CONCENTRATED COLOR DEVELOPER COMPOSITION USED FOR SILVER HALIDE PHOTOGRAPHIC MATERIAL AND PROCESSING METHOD BY USE THEREOF

(75) Inventor: Atsuro Yanata, Hino (JP)

(73) Assignee: Konica Corporation (JP)

( * ) Notice: Subject to any disclaimer, the term of this patent is extended or adjusted under 35 U.S.C. 154(b) by 184 days.

(21) Appl. No.: 10/350,391

(22) Filed: Jan. 23, 2003

(65) Prior Publication Data

US 2003/0190559 A1 Oct. 9, 2003

(30) Foreign Application Priority Data

Feb. 1, 2002 (JP) ..... 2002-024954

(51) Int. Cl.[7] ..... G03C 7/407; G03C 7/413
(52) U.S. Cl. ..... 430/466; 430/490
(58) Field of Search ..... 430/466, 490

(56) References Cited

U.S. PATENT DOCUMENTS 5,028,517 A * 7/1991 Kuse et al. ..... 430/434
5,100,765 A * 3/1992 Fujimoto ..... 430/434
5,354,646 A * 10/1994 Kobayashi et al. ..... 430/372
5,459,014 A * 10/1995 Nishijima et al. ..... 430/372
5,547,817 A * 8/1996 Okada et al. ..... 430/393
5,595,860 A * 1/1997 Ishikawa et al. ..... 430/372
6,043,007 A 3/2000 Abe ..... 430/403
6,274,300 B1 * 8/2001 Seki ..... 430/466
2002/0061475 A1 * 5/2002 Duan ..... 430/435

FOREIGN PATENT DOCUMENTS

| | | |
|---|---|---|
| EP | 0426062 | 5/1991 |
| EP | 0528406 | 2/1993 |
| EP | 1283445 | 2/2003 |

OTHER PUBLICATIONS

European Search Report EP 03 25 0543.

* cited by examiner

*Primary Examiner*—Hoa Van Le
(74) *Attorney, Agent, or Firm*—Muserlian, Lucas and Mercanti

(57) ABSTRACT

A color developer concentrate composition is disclosed, comprising a color developing agent, a sulfite and a compound represented by formula (1), the color developing agent concentration 0.02 to 0.2 mol/l and the sulfite concentration meeting the following requirement:

0.1<sulfite concentration (mol/l)/color developing agent concentration (mol/l)<10

$HO—N—(X\text{-}A)_2$ formula (1)

9 Claims, No Drawings

CONCENTRATED COLOR DEVELOPER COMPOSITION USED FOR SILVER HALIDE PHOTOGRAPHIC MATERIAL AND PROCESSING METHOD BY USE THEREOF

FIELD OF THE INVENTION

The present invention relates to a concentrated color developer composition for use in silver halide photographic materials (hereinafter, also denoted simply as photographic materials) and a processing method by use thereof, and in particular, to a concentrated color developer composition exhibiting reduced degradation of ingredients during storage at relatively high temperature, reduced precipitation onto the processing bath during running and reduced staining of processed photographic materials, and a processing method of photographic materials by use thereof.

BACKGROUND OF THE INVENTION

Photographic color developer compositions are used for processing photographic material providing an intended image. In general, such a composition contains a color developing agent as a reducing agent, forming an intended dye upon reaction with a dye forming coupler.

To replenish processing components which have been consumed in reaction or carried out by processed photographic material, color developer replenishing solution is supplied to color developing solution in a color developing tank. Such replenishment is designed so as to maintain uniform development and stability of the color developing agent. A color developer replenishing solution is usually prepared by mixing plural parts with water immediately before use thereof. In the photographic industry, reducing the number of such parts used for preparation of the replenishing solution has been desired to reduce troublesome handling. There has been disclosed a replenishing solution ready to use as such and a concentrated single part solution which was usable only by dilution with water, e.g., in JP-A 2001-100382 (hereinafter, the term, JP-A refers to Japanese Patent Application publication).

However, although the foregoing prior art was effective to prevent deposits during storage at relative low temperature, problems arose such that degradation of processing components occurred during storage at relative high temperature. It was further proved that precipitation onto the processing tank and staining of photographic material were caused during processing.

SUMMARY OF THE INVENTION

Accordingly, it is an object of the invention to provide a concentrated color developer composition which is stable even when aged at relative high temperature and which has achieved reduced precipitation onto the processing tank and less staining of processed photographic material, and a method for processing photographic materials by use thereof.

The present invention comprises the following constitution to solve the foregoing problem:

1. A color developer concentrate composition comprising a color developing agent, a sulfite and a compound represented by formula (1), the color developing agent concentration being 0.02 to 0.2 mol/l and the sulfite concentration meeting the following requirement:

0.1<sulfite concentration (mol/l)/color developing agent concentration (mol/l)<10

$$HO—N—(X\text{-}A)_2 \qquad \text{formula (1)}$$

wherein X is an alkylene group, which may be substituted; A is a carboxyl group, sulfo group, phosphono group, hydroxy group, alkoxy group, amino group, ammonio group, sulfamoyl group or sulfamoyl group, each of which may be in the form of a salt thereof;

2. The color developer concentrate composition described in 1., wherein the composition further comprises a compound represented by formula (2) or (3):

$$HO—NH—X\text{-}A \qquad \text{formula (2)}$$

$$Y—R—SO_3M \qquad \text{formula (3)}$$

wherein X and A are the same as defined in the foregoing formula (1); Y is a hydroxy group, halogen atom, alkoxy group which may be substituted, sulfo group or sulfonate, sulfuric ester group or sulfate ester, or sulfonyl halide; R is a straight chain or branched alkylene group having 1 to 5 carbon atoms; M is Li, Na, K or $NH_4$;

3. The color developer concentrate composition described in 1. or 2., wherein the composition further comprises a compound represented by formula (4):

$$HO—(R—O)_n—H \qquad \text{formula (4)}$$

wherein R is $—CH_2—CH_2—$, $—CH_2—CH_2—CH_2—$, or $—CH_2—CH(CH_3)—$; and n is an integer of 1 to 30;

4. The color developer concentrate composition described in 1. 2. or 3., wherein the composition further comprises a compound represented by formula (5) through (7):

formula (5)

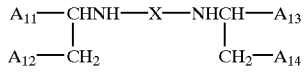

wherein $A_{11}$, $A_{12}$, $A_{13}$ and $A_{14}$, which may be the same or different, are each $—CH_2OH$, $—PO_3(M_6)_2$ or $—COOM_7$, in which $M_6$ and $M_7$ are each a hydrogen atom, ammonium group, an alkali metal atom or organic ammonium group; X is an alkylene group having 2 to 6 carbon atoms or $—(B_1O)_n—B_2—$, in which n is an integer of 1 to 6 and $B_1$ and $B_2$ are each an alkylene group having 1 to 6 carbon atoms, which may be the same or different;

formula (6)

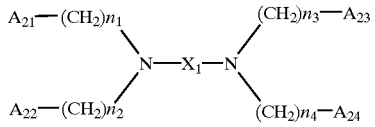

wherein $A_{21}$, $A_{22}$, $A_{23}$ and $A_{24}$, which may be the same or different, are each $—CH_2OH$, $—COOM^1$ or $—PO_3(M^2)_2$, in which $M^1$ and $M^2$ are each a hydrogen atom, ammonium group, alkali metal atom or organic ammonium group; $X_1$ is a straight chain or branched alkylene group having 2 to 6 carbon atoms, saturated or unsaturated cyclic organic group or $—(B_{11}O)_{n5}—B_{12}—$, in which n5 is an integer of 1 to 6, and $B_{11}$ and $B_{12}$ are either the same or different and an alkylene group having 1 to 5 carbon atoms; n1, n2, n3 and n4 are either the same or different and an integer of 1 or more, provided that at least one of n1, n2, n3 and n4 is 2 or more;

formula (7)

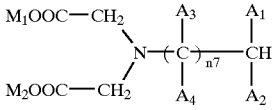

wherein $A_1$, $A_2$, $A_3$ and $A_4$ are either the same or different and a hydrogen atom, hydroxy group, —$COOM_3$, —$PO_3(M_4)_2$, —$CH_2COOM_5$, —$CH_2OH$ or a lower alkyl group, in which $M_1$, $M_2$, $M_3$, $M_4$ and $M_5$ are each a hydrogen atom, ammonium group, alkali metal atom or organic ammonium group, provided that at least one of $A_1$, $A_2$, $A_3$ and $A_4$ is —$COOM_3$, —$PO_3(M_4)_2$ or —$CH_2COOM_5$; n7 is an integer of 0 to 2;

5. The color developer concentrate composition described in any of 1. to 4., wherein the color developing agent is a hydroxyalkyl-substituted p-phenylenediamine type color developing agent;

6. A method for processing a silver halide color photographic material, wherein the color developer concentrate composition described in any of 1. through 4 is directly replenished to a color developing tank in an automatic processor in accordance with a processing volume of the photographic material;

7. The method for processing a silver halide color photographic material described in 6., wherein water is directly replenished to a color developing tank in an automatic processor in accordance with a processing volume of the photographic material.

EMBODIMENTS OF THE INVENTION

Specific examples of the compound represented by formula (1) are shown below but the invention is by no means limited to these.

1-1

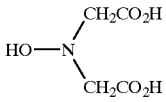

1-2

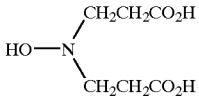

1-3

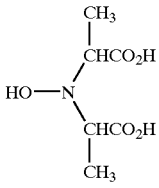

1-4

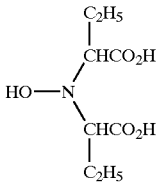

-continued 1-5

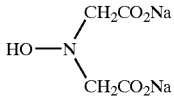

1-6

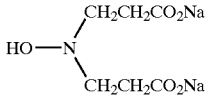

1-7

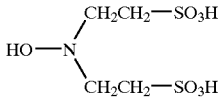

1-8

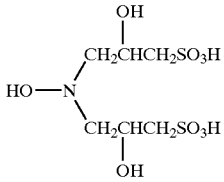

1-9

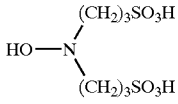

1-10

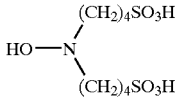

1-11

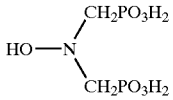

1-12

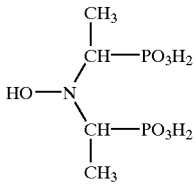

1-13

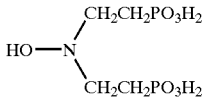

1-14

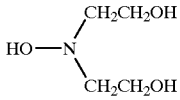

1-15

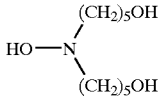

1-16

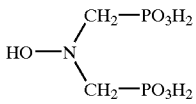

1-17

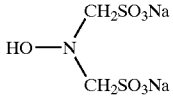

-continued 1-18

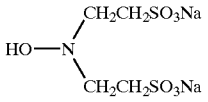

1-19

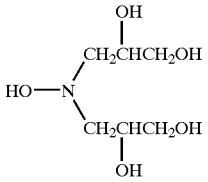

1-20

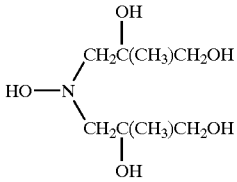

The compound represented by formula (1) is preferably contained in an amount of 0.01 to 0.1 mol/l.

Specific examples of the compound represented by formula (2) are shown below but the invention is by no means limited to these.

2-1 $HO—NH—CH_2CO_2H$ 2-2 $HO—NH—CH_2CH_2CO_2H$ 2-3 $HO—NH—CH(CH_3)—CO_2H$ 2-4 $HO—NH—CH(C_2H_5)—CO_2H$ 2-5 $HO—NH—CH_2CO_2Na$ 2-6 $HO—NH—CH_2CH_2CO_2Na$ 2-7 $HO—NH—CH_2CH_2—SO_3H$ 2-8 $HO—NH—CH_2CH(OH)CH_2SO_3H$ 2-9 $HO—NH—(CH_2)_3SO_3H$ 2-10 $HO—NH—(CH_2)_4SO_3H$ 2-11 $HO—NH—CH_2PO_3H_2$ 2-12 $HO—NH—CH(CH_3)—PO_3H_2$ 2-13 $HO—NH—CH_2CH_2PO_3H_2$ 2-14 $HO—NH—CH_2CH_2OH$ 2-15 $HO—NH—(CH_2)_3OH$ 2-16 $HO—NH—CH—PO_3H_2$ 2-17 $HO—NH—CH_2SO_2Na$

-continued 2-18 $HO—NH—CH_2CH_2SO_3Na$ 2-19 $HO—NH—CH_2—CH(OH)—CH_2—OH$ 2-20 $HO—NH—CH_2—C(CH_3)(OH)—CH_2—OH$ Specific examples of the compound represented by formula (3) are shown below but the invention is by no means limited to these.

3-1 $HO—CH_2CH_2—SO_3H$ 3-2 $HO—CH_2CH_2—SO_3Na$ 3-3 $HO—CH_2CH_2—SO_3K$ 3-4 $HO—CH(CH_3)CH_2—SO_3Na$ 3-5 $HO—CH_2CH(CH_3)—SO3Na$ 3-6 $HO—CH_2CH_2CH_2—SO_3Na$ 3-7 $HO—CH_2CH(C_2H_5)—SO_3Na$ 3-8 $HO_3SO—CH_2CH_2—SO_3H$ 3-9 $NaO_3SO—CH_2CH_2—SO_3Na$ 3-10 $KO_3SO—CH_2CH_2—SO_3K$ 3-11 $HO_3S—CH_2CH_2—SO_3H$ 3-12 $NaO_3S—CH_2CH_2—SO_3Na$ 3-13 $Cl—CH_2—SO_3H$ 3-14 $Br—CH_2CH_2—SO_3Na$ 3-15 $Br—CH(CH_3)CH_2SO_3Na$ 3-16 $ClO_2S—CH_2CH_2SO_3H$ 3-17 $NaO_3S—CH_2CH_2—O—CH_2CH_2SO_3Na$ 3-18 $HO—CH_2—CH(SO_3Na)—CH_2CH_2—SO_3Na$

The compound represented by formula (2) or the compound represented by formula (3) is preferably contained in a ratio of the compound represented by formula (2) or (3) to the compound represented by formula (1) of 1:1000 to 1:1, and more preferably 1:100 to 1:10. In other words, the molar ratio of the compound of formula (2) or (3) to the compound of formula (1) is preferably 1/1000 to 1/1, and more preferably 1/100 to 1/10.

Next, the concentrated color developer composition of the will be described. The concentrated color developer composition contains a color developing agent in an amount of 0.02 to 0.2 mol/l, preferably 0.03 to 0.1 mol/l, and more preferably 0.03 to 0.08 mol/l. Color developing agents usable in the invention include those which are commonly known in the photographic art.

Color developing agents used in the invention are para-phenylenediamine type color developing agents, which are commonly known in the photographic art and are selected from derivatives of para-phenylenediamine (hereinafter, also denoted as p-phenylenediamine), i.e., p-phenylenediamine compounds.

The p-phenylenediamine-type color developing agent is represented by the following general formula:

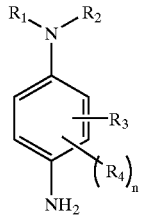

wherein $R_1$, $R_2$, $R_3$ and $R_4$ each are independently a hydrogen atom, halogen atom, carboxyl group, sulfo group, sulfamoyl group, alkylsulfonyl group, or an alkyl, alkoxy or aryl group, which may be substituted, provided that $R_2$ and $R_3$, or $R_3$ and $R_4$ may combine with each other to form a ring; n is an integer of 0 to 3.

The p-phenylenediamine-type color developing agents used in the invention preferably are a p-phenylenediamine compound having a water-solubilizing group (i.e., group promoting solubility in water) to achieve effects of the invention. Thus, the p-phenylenediamine compound having a water-solubilizing group exhibits advantages such as causing no stain in photographic material and no skin irritation, as compared to p-phenylenediamine type compound having no water-solubilizing group, such as N,N-diethyl-p-phenylenediamine. The water-solubilizing group is substituted onto an amino group or on a benzene nucleus of the p-phenylenediamine compound. Preferred examples of the water-solubilizing group include $—(CH_2)_n—CH_2OH$, $—(CH_2)_m—NHSO_2—(CH_2)_n—CH_3$, $—(CH_2)_m—O—(CH_2)_n—CH_3$, $—(CH_2CH_2O)_n—C_mH_{2m+1}$, —COOH and $—SO_3H$, in which m and n are each an integer of 0 or more. Of these water-solubilizing groups, $—(CH_2)_n—CH_2OH$ is more preferred. Thus, hydroxyalkyl-substituted p-phenylenediamine type color developing agents are more preferred.

Preferred examples of the p-phenylenediamine type color developing agents used in the invention are shown below.

(1)

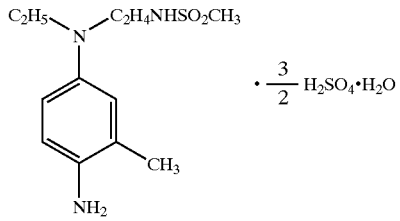

(2)

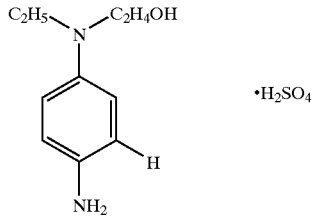

-continued (3)

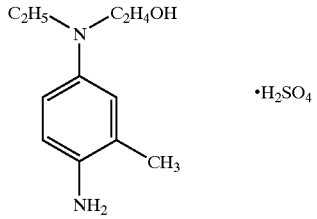

(4)

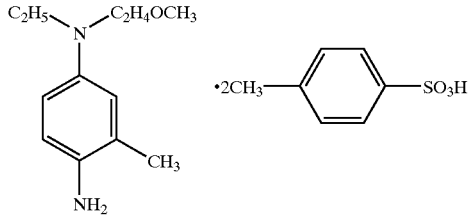

(5)

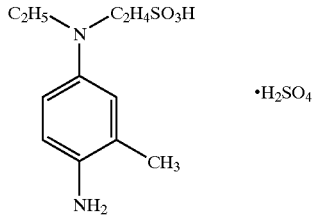

(6)

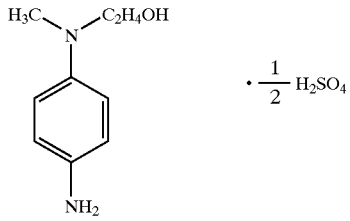

(7)

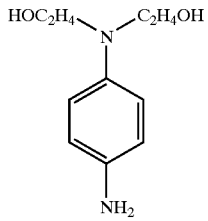

(8)

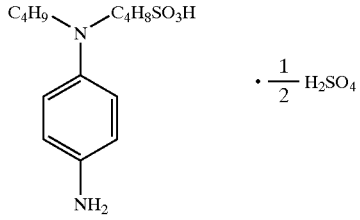

(9)

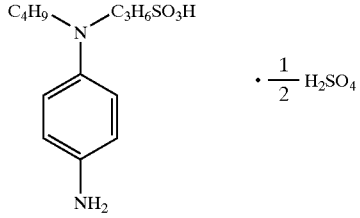

-continued (10)

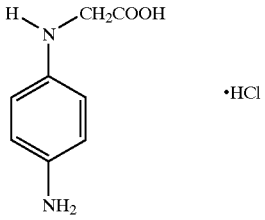

(11)

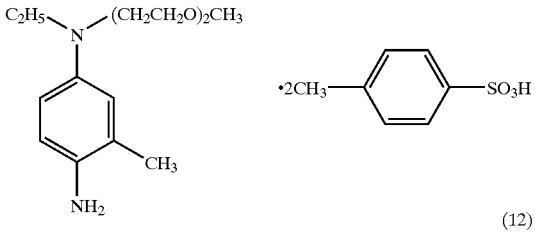

(12)

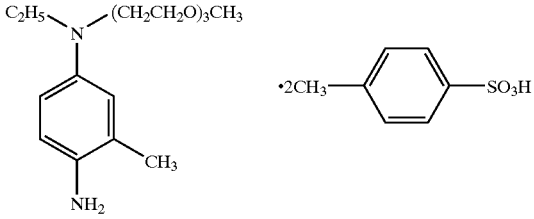

(13)

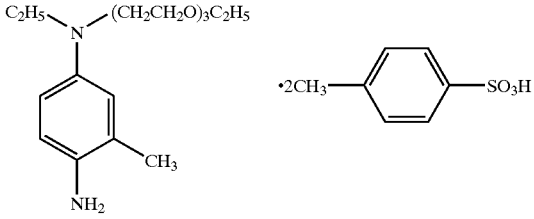

(14)

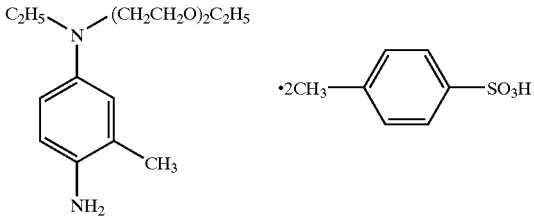

(15)

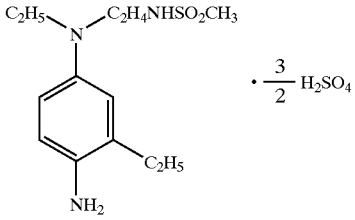

(16)

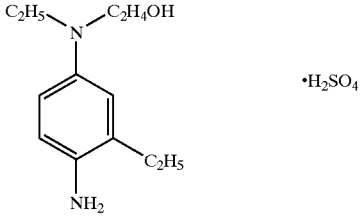

-continued (17)

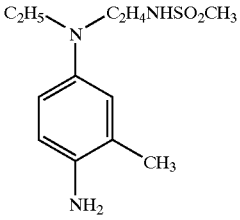

(18)

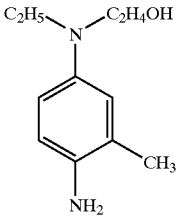

Of the foregoing exemplified color developing agents, compound (3) is specifically preferred, which is hereinafter denoted as CD-4.

The concentrated color developer composition of the invention contains a sulfite salt (e.g., sodium or potassium sulfite). In the invention, the concentration of the sulfite salt (hereinafter, also denoted as sulfite concentration) satisfies the following requirement (i.e., ratio of sulfite concentration or color developing agent concentration):

0.1<sulfite concentration (mol/l)/color developing agent concentration (mol/l)<10, and preferably falling within the following range:

0.3<sulfite concentration (mol/l)/color developing agent concentration (mol/l)<5.

The concentrated color developer composition preferably contains the compound represented by formula (4), as described earlier. Specific examples of the compound represented by formula (4) are shown below but are not limited to these.

(4)-1 Ethylene glycol
(4)-2 Diethylene glycol
(4)-3 Triethylene glycol
(4)-4 Tetraethylene glycol
(4)-5 Propylene glycol
(4)-6 Dipropylene glycol
(4)-7 Tripropylene glycol
(4)-8 Polyethylene glycol #200 (M.W. 200)
(4)-9 Polyethylene glycol #300 (M.W. 300)
(4)-10 Polyethylene glycol #400 (M.W. 400)
(4)-11 Polyethylene glycol #600 (M.W. 600)
(4)-12 Polyethylene glycol #100 (M.W. 100)
(4)-13 Polypropylene glycol (M.W. 400)
(4)-14 Polypropylene glycol (M.W. 700)

Of these, compounds (4)-1, 2, 8, 9 and 10 are preferred. The compound represented by formula (4) is preferably contained in an amount of 1 to 50 g/l, and more preferably 4 to 30 g/l when the concentrated color developer composition is diluted 4 times and used as a color developer replenishing solution.

Allowing chelating agents to be contained in the concentrated color developer composition can prevent contamination due to heavy metals, thereby enhancing preservative capability. Specifically, the use of chelating agents represented by formula (5), (6) or (7) described earlier leads to markedly enhanced effects of the invention.

Next, the compounds represented by formula (5), (6) or (7) will be detailed.

In formula (5), $A_{11}$ through $A_{14}$ are either the same or different and represent —$CH_2OH$, —$PO_3(M_6)_2$ or —$COOM_7$, in which $M_6$ and $M_7$ are each a hydrogen atom, ammonium, an alkali metal atom (e.g., sodium, potassium), or an organic ammonium group (e.g., methylammonium, trimethylammonium); X represents an alkylene group having 2 to 6 carbon atoms, which may be substituted, or —$(B_1O)_n$—$B_2$—, in which $B_1$ and $B_2$ are either the same of different and represent an alkylene group having 1 to 5 carbon atoms. Examples of the alkylene group represented by X include ethylene, trimethylene and tetramethylene. Examples of the alkylene group represented by $B_1$ and $B_2$ include methylene, ethylene and trimethylene. The alkylene group represented by X, $B_1$ and $B_2$ may be substituted and examples of a substituent include hydroxy, an alkyl group having 1 to 3 carbon atoms (e.g., methyl, ethyl); and n is an integer of 1 to 6, and preferably an integer of 1 to 4.

Specific examples of the compound represented by formula (5) are shown below but are not limited to these.

5-1

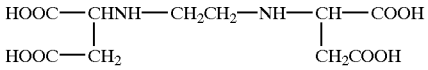

5-2

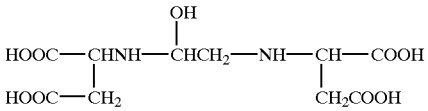

5-3

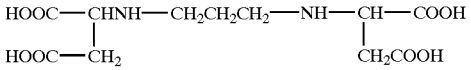

5-4

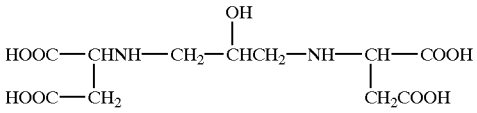

5-5

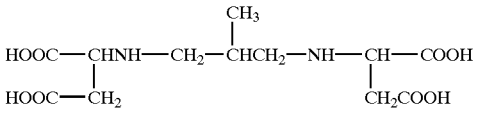

5-6

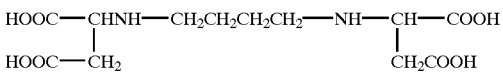

5-7

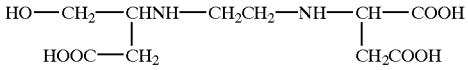

5-8

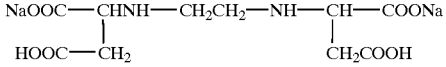

5-9

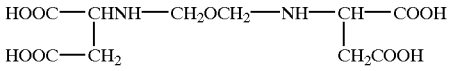

5-10

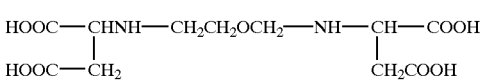

5-11

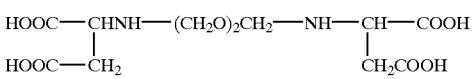

-continued 5-12

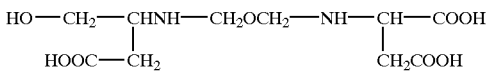

5-13

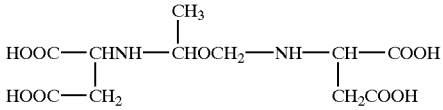

5-14

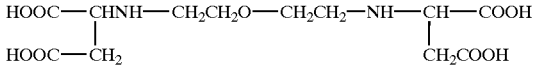

5-15

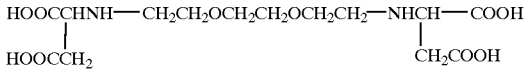

5-16

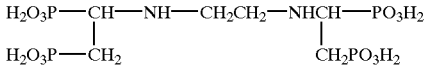

5-17

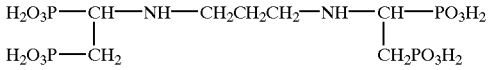

Compounds represented by formula (5) can be readily synthesized in accordance with commonly known methods. Of the foregoing compounds, compounds (5-1), (5-3) and (5-14) are preferred. The compounds represented by formula (5) include isomers. Any isomer thereof is preferred. Of the isomers, isomer (S,S) is specifically preferred.

Next, the compound represented by formula (6) will be described. In formula (6), $A_{21}$ through $A_{24}$ are either the same or different and represent —$CH_2OH$, —$PO_3(M^2)_2$ or —$COOM^1$, in which $M^1$ and $M^2$ are each a hydrogen atom, ammonium, an alkali metal atom (e.g., sodium, potassium), or an organic ammonium group (e.g., methylammonium, trimethylammonium).

$X_1$ represents a straight chain or branched alkylene group having 2 to 6 carbon atoms, saturated or unsaturated cyclic organic group or —$(B_{11}O)_{n5}$—$B_{12}$—, in which $B_{11}$ and $B_{12}$ are either the same of different and represent an alkylene group having 1 to 5 carbon atoms, which may be substituted. Examples of the alkylene group represented by $X_1$ include ethylene, trimethylene and tetramethylene. Examples of the alkylene group represented by $B_{11}$ and $B_{12}$ include methylene, ethylene and trimethylene. The alkylene group represented by $X_1$, $B_{11}$ and $B_{12}$ may be substituted and examples of a substituent include hydroxy, an alkyl group having 1 to 3 carbon atoms (e.g., methyl, ethyl); and n5 is an integer of 1 to 6, preferably an integer of 1 to 4, and more preferably 1 or 2.

Specific examples of the compound represented by formula (6) are shown below but are not limited to these.

6-1

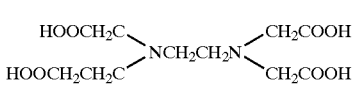

6-2

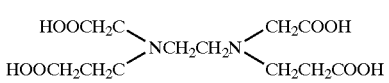

-continued
6-3
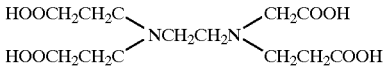
6-4
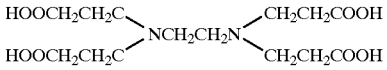
6-5
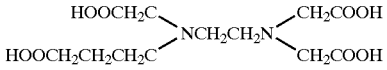
6-6
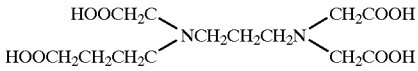
6-7
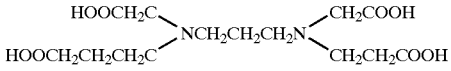
6-8
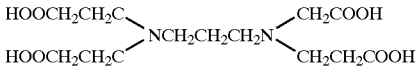
6-9
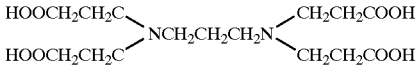
6-11
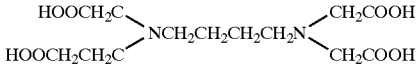
6-12
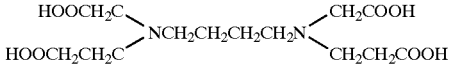
6-13
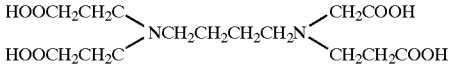
6-14
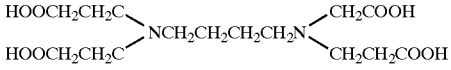
6-15
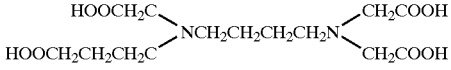
6-16
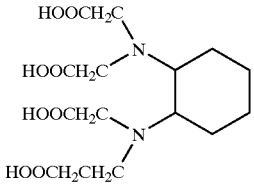
6-17
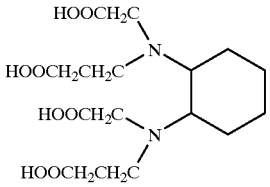
6-18
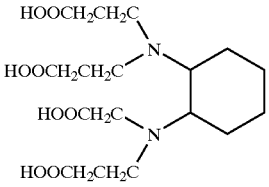
6-19
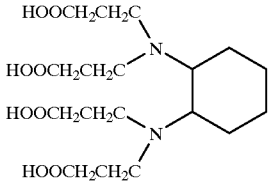
6-20
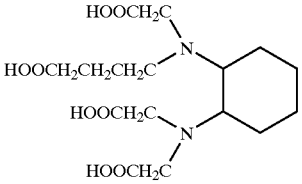
6-21
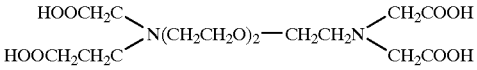
6-22
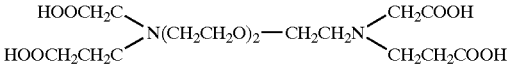
6-23
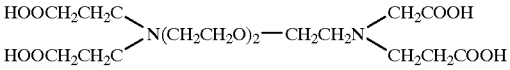
6-24
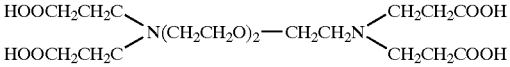
6-25
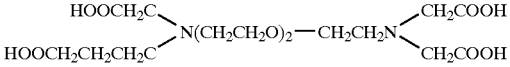
6-26
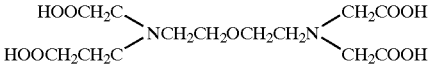
6-27
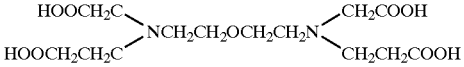
6-28
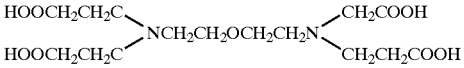
6-29
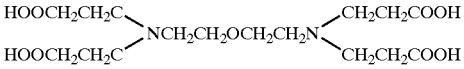
6-30
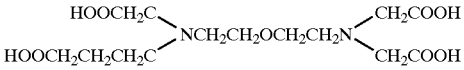
6-31
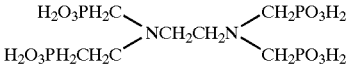
6-32
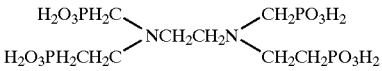
6-33
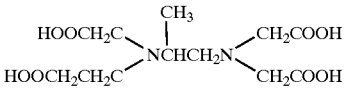

-continued 6-34

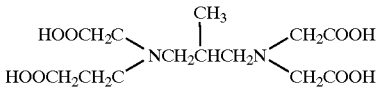

Of the foregoing compounds, (6-16), (6-17), (6-18), (6-19) and (6-20) include both cis-isomers. The compound represented by formula (6) can be readily synthesized by the commonly known method. Of the foregoing compounds, (6-1), (6-2) and (6-6) are preferred.

The compound represented by formula (5) or (6) is preferably contained in an amount of 0.001 to 0.1 mol/l, and more preferably 0.005 to 0.05 mol/l when the concentrated color developer composition is diluted 4 times and used as a color developer replenishing solution.

Next, the compound represented by formula (7) described earlier will be described. In formula (7), $A_1$, $A_2$, $A_3$ and $A_4$ are either the same or different and represent a hydrogen atom, hydroxy, —$COOM_3$, —$PO_3(M_4)_2$, —$CH_2COOM_5$, —$CH_2OH$ or a lower alkyl group (e.g., methyl, ethyl isopropyl, n-propyl), in which $M_1$, $M_2$, $M_3$, $M_4$ and $M_5$ are each a hydrogen atom, ammonium, alkali metal atom or organic ammonium group (and preferably a hydrogen atom, sodium or potassium atom), provided that at least one of $A_1$, $A_2$, $A_3$ and $A_4$ is —$COOM_3$, —$PO_3(M_4)_2$ or —$CH_2COOM_5$; n7 is an integer of 0 to 2.

Specific examples of preferred compounds represented by formula (7) are shown below.

7-1

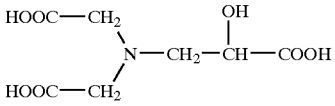

7-2

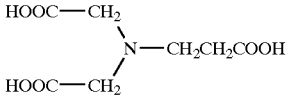

7-3

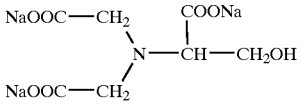

7-4

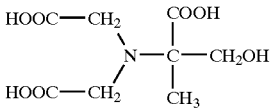

7-5

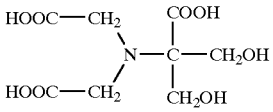

7-6

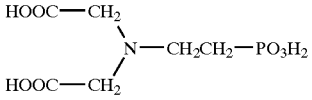

7-7

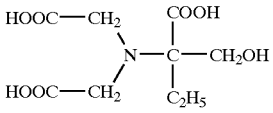

-continued 7-8

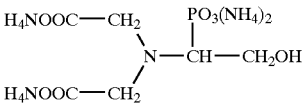

7-9

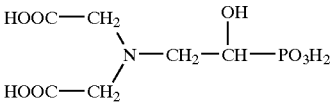

7-10

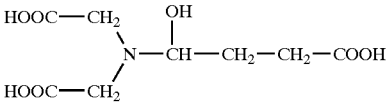

7-11

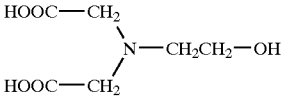

7-12

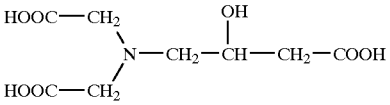

7-13

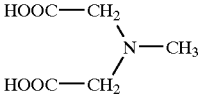

The chelating agent represented by formula (7) is preferably contained in an amount of 0.001 to 0.1 mol/l, and more preferably 0.005 to 0.05 mol/l when the concentrated color developer composition is diluted 4 times and used as a color developer solution.

The concentrated color developer composition is diluted at least 4 times and used as a worker of color developer solution, in which the developing temperature is, for example, 20 to 55° C., and preferably 30 to 55° C. In the case of camera material, the developing time is, for example, 20 sec. to 10 min., preferably 30 sec. to 8 min., more preferably 1 to 6 min., and still more preferably 1 min 10 sec, to 3 min. 30 sec.

When used to develop photographic material, the concentrated color developer composition of the invention may be diluted with water in a prescribed proportion to prepare a color developer replenishing solution. The concentrated composition preferably is directly supplied as such to a color developer tank of the automatic processor as a replenisher. In this case, in addition to the concentrated composition, water may be supplied to the color developer tank.

EXAMPLES

Embodiments of the invention will be further described based on examples.

Example 1

A concentrated color developer composition was prepared in accordance with the following formula.

Sodium sulfite, in an amount shown in Table 1

| | |
|---|---|
| Potassium carbonate | 80 g |
| Sodium diethylenetriaminopentaacetate | 10 g |

-continued

| | |
|---|---|
| Potassium bromide | 0.5 g |
| Compound shown in Table 1, in an amount of Table 1 | |
| CD-4, in an amount shown in Table 1 | |
| pH | 10.30 |

The total volume was made to 1 liter with water and the pH was adjusted with 50% sulfuric acid or potassium hydroxide. The thus prepared concentrated color developer composition was put into a hermetically sealed container and aged in an incubator maintained at 50° C. for 2 months.

The developer composition was diluted two times with water to prepare a color developer replenishing solution. The replenishing solution was put into a polyethylene vessel having an open top area ratio of 0.15 $cm^{-1}$. and having been aged for one month in an incubator maintained at 30° C. After being aged, precipitation onto the wall of the vessel and the residual content of CD-4 (expressed in %) were measured. Furthermore, using the aged replenishing solution, photographic material was continuously processed to evaluate running performance. In the running process, Konica Color CENTURIA 800, CENTURIA 400 and CENTURIA 100 (each of which were 35 mm side, 24 exposure) were used in a ration of 50:25:25. These film samples were exposed by making practical camera exposure.

The thus exposed samples were processed in a volume of 50 rolls per day until the replenished volume reached 3 times the processing tank volume. There was used an automatic processor KP-46QA, available from Konica Corp.

Processing Step and Condition

| Step | Time | Temperature | Replenishing Rate | Tank Volume |
|---|---|---|---|---|
| Developing | 3 min. 15 sec. | 38.0° C. | 500 ml/$m^2$ | 16.4 lit. |
| Bleaching | 45 sec. | 38.0° C. | 130 ml/$m^2$ | 3.9 lit. |
| Fixing-1 | 45 sec. | 38.0° C. | *1 | 3.9 lit. |
| Fixing-2 | 45 sec. | 38.0° C. | 600 ml/$m^2$ | 3.9 lit. |
| Stabilizing-1 | 30 sec. | 38.0° C. | *2 | 3.9 lit. |
| Stabilizing-2 | 30 sec. | 38.0° C. | *2 | 3.9 lit. |
| Stabilizing-3 | 30 sec. | 38.0° C. | 1000 ml/$m^2$ | 3.9 lit. |
| Drying | 1 min. | 55° C. | | |

*1: Cascade flow from 2 to 1
*2: Cascade flow from 3 to 2 and from 2 to 1

A color developer starting solution, bleaching solution, fixing solution and stabilizing solution were each prepared according to the following formulas.

Color Developer Working Solution (per liter)

| | |
|---|---|
| Sodium sulfite | 2.0 g |
| Potassium carbonate | 40 g |
| Pentasodium diethylenetriaminepentaacetate | 4 g |
| Potassium bromide | 1.5 g |
| Potassium iodide | 2 mg |
| Compound shown in Table 1 | 5 g |

-continued

| | |
|---|---|
| CD-4 | 4.5 g |
| pH | 10.00 |

(pH was adjusted with sulfuric acid or sodium hydroxide)

| Bleaching solution (per liter) | Worker | Replenisher |
|---|---|---|
| Sodium 1,3-propylenediaminetetraacetate iron (III) | 133 g | 190 g |
| 1,3-propylenediaminetetraacetic acid | 5 g | 7 g |
| Ammonium bromide | 60 g | 90 g |
| Maleic acid | 40 g | 60 g |
| Imidazole | 10 g | 15 g |
| pH | 4.5 | 3.5 |

Water was added to make 1 liter and the pH was adjusted with ammonia water or 50% sulfuric acid.

| | Worker/Replenisher |
|---|---|
| Fixing solution (per liter) | |
| Ammonium thiosulfate | 200 g |
| Sodium sulfite | 15 g |
| Disodium ethylenediaminetetraacetae | 2 g |
| pH | 7.0 |
| Stabilizing solution (per liter) | |
| m-Hydroxybenzaldehyde | 1.0 g |
| Disodium ethylenediaminetetraacetate | 0.6 g |
| β-Cyclodextrin | 0.2 g |
| Potassium carbonate | 0.2 g |
| pH | 8.5 |

Upon completion of running process, photographic material (Konica Color CENTURIA 400), exposed through an optical wedge was processed and yellow densities were measured with respect to minimum and maximum density areas (DminY, DmaxY). At the start of running process on the final day, the extent of staining onto the surface of processed film was evaluated. Results are shown in Table 1.

Extent of Precipitation on the Tank Walls

A: No deposits were observed,

B: Slight deposits were observed on portions of the walls but acceptable level,

C: Deposits were observed on almost all portions of the walls,

D: Deposits were observed not only on the wall but also on the surface of the liquid, E: deposits were observed on the almost the entire surface of the liquid.

Extent of Staining onto the Film Surface

A: No staining was observed from the first roll,

B: Slight staining was observed on the first film but none was observed on subsequent rolls, C: Slight staining was observed on the first few rolls, D: Staining was observed on the first few rolls and slight staining was observed on subsequent rolls, E: Staining was observed on almost all of the rolls.

TABLE 1

| Experiment No. | Compound | CD-4 (mol/l) | Na-sulfite (mol/l) | Sulfite Ratio*1 | Replenisher Stability: Precipitation | Replenisher Stability: Residual CD-4 (%) | Running Performance: DminY | Running Performance: DmaxY | Running Performance: Staining | Remark |
|---|---|---|---|---|---|---|---|---|---|---|
| 1-1 | 1-18 | 0.03 | 0 | 0.00 | D | 41 | 1.03 | 2.08 | E | Comp. |
| 1-2 | 1-18 | 0.01 | 0.03 | 3.00 | C | 77 | 0.82 | 1.60 | C | Comp. |
| 1-3 | 1-18 | 0.03 | 0.0015 | 0.05 | C | 86 | 0.99 | 2.45 | C | Comp. |
| 1-4 | 1-18 | 0.05 | 0.0015 | 0.03 | C | 74 | 0.98 | 2.55 | C | Comp. |
| 1-5 | 1-18 | 0.03 | 0.005 | 0.17 | C | 87 | 0.93 | 2.73 | B | Inv. |
| 1-6 | 1-18 | 0.05 | 0.005 | 0.10 | C | 86 | 0.90 | 2.77 | B | Inv. |
| 1-7 | 1-18 | 0.03 | 0.01 | 0.33 | B | 88 | 0.93 | 2.79 | B | Inv. |
| 1-8 | 1-18 | 0.05 | 0.01 | 0.20 | C – B | 85 | 0.92 | 2.84 | B | Inv. |
| 1-9 | 1-18 | 0.02 | 0.015 | 1.33 | B | 85 | 0.85 | 2.65 | B | Inv. |
| 1-10 | 1-18 | 0.03 | 0.03 | 1.00 | B | 90 | 0.90 | 2.77 | B | Inv. |
| 1-11 | 1-18 | 0.05 | 0.03 | 0.60 | B | 88 | 0.91 | 2.80 | B | Inv. |
| 1-12 | 1-18 | 0.03 | 0.05 | 1.67 | B | 93 | 0.90 | 2.79 | B | Inv. |
| 1-13 | 1-18 | 0.05 | 0.05 | 1.00 | B | 92 | 0.91 | 2.81 | B | Inv. |
| 1-14 | 1-18 | 0.07 | 0.05 | 0.71 | B | 90 | 0.94 | 2.82 | B | Inv. |
| 1-15 | 1-18 | 0.05 | 0.1 | 2.00 | B | 95 | 0.89 | 2.75 | B | Inv. |
| 1-16 | 1-18 | 0.05 | 0.3 | 6.00 | B | 93 | 0.88 | 2.67 | B | Inv. |
| 1-17 | 1-18 | 0.05 | 1 | 20.00 | B | 92 | 1.00 | 2.45 | B | Comp. |
| 1-18 | 1-8 | 0.05 | 0.03 | 0.60 | B | 87 | 0.94 | 2.72 | B | Inv. |
| 1-19 | 1-9 | 0.05 | 0.03 | 0.60 | B | 89 | 0.96 | 2.75 | B | Inv. |
| 1-20 | 1-2 | 0.05 | 0.03 | 0.60 | B | 84 | 0.90 | 2.78 | B | Inv. |
| 1-21 | 1-14 | 0.05 | 0.03 | 0.60 | B | 90 | 0.99 | 2.70 | B | Inv. |
| 1-22 | HAS*2 | 0.05 | 0.05 | 1.00 | C | 87 | 1.53 | 2.34 | D | Comp. |
| 1-23 | — | 0.05 | 0.03 | 0.60 | E | 55 | 1.34 | 2.18 | E | Comp. |

*1molar ratio of sulfite (mol/l) to CD-4 (mol/l)
*2hydroxylamine sulfate

As can be seen from Table 1, it was proved that the combination of compounds according to the invention led to reduced precipitation and enhanced CD-4 residual ratio in replenishing solution aged at high temperature and superior running processing performance. It was also proved that the color developing agent concentration was effective at not less than 0.02 mol/l and preferably at not less than 0.03 mol/l and compound 1-18 was preferable. It was further proved that the ratio of sulfite concentration to developing agent concentration was effective at not less than 0.1 and preferably at not less than 1.0.

Example 2

Experiments were conducted similarly to Experiment No. 1-13 in Example 1, provided that the developer composition further contained compounds shown in Table 2 and aged in the incubator at 50° C. for 3 months. Results thereof are shown in Table 2.

TABLE 2

| Experiment No. | Compound | Content (mol/l) | Molar Ratio*1 | Replenisher Stability: Precipitation | Replenisher Stability: Residual CD-4 (%) | Running Performance: DminY | Running Performance: DmaxY | Running Performance: Staining |
|---|---|---|---|---|---|---|---|---|
| 2-1 | — | 0 | 0 | B | 92 | 0.91 | 2.81 | B |
| 2-2 | 2-7 | $3.0\times10^{-5}$ | 0.001 | B | 93 | 0.90 | 2.80 | B |
| 2-3 | 2-7 | $6.0\times10^{-5}$ | 0.002 | A | 95 | 0.88 | 2.84 | B |
| 2-4 | 2-7 | $1.5\times10^{-4}$ | 0.005 | A | 97 | 0.88 | 2.82 | B |
| 2-5 | 2-7 | $3.0\times10^{-4}$ | 0.01 | A | 98 | 0.85 | 2.85 | A |
| 2-6 | 2-7 | $1.5\times10^{-3}$ | 0.05 | A | 98 | 0.85 | 2.84 | A |
| 2-7 | 2-7 | $3.0\times10^{-3}$ | 0.1 | A | 98 | 0.85 | 2.83 | A |
| 2-8 | 2-7 | $6.0\times10^{-3}$ | 0.2 | B | 97 | 0.86 | 2.80 | A |
| 2-9 | 2-7 | $1.5\times10^{-2}$ | 0.5 | B | 97 | 0.87 | 2.74 | B |
| 2-10 | 3-1 | $3.0\times10^{-5}$ | 0.001 | B | 93 | 0.90 | 2.80 | B |
| 2-11 | 3-1 | $6.0\times10^{-5}$ | 0.002 | A | 96 | 0.88 | 2.84 | B |
| 2-12 | 3-1 | $1.5\times10^{-4}$ | 0.005 | A | 97 | 0.88 | 2.82 | B |
| 2-13 | 3-1 | $3.0\times10^{-4}$ | 0.01 | A | 97 | 0.85 | 2.85 | A |
| 2-14 | 3-1 | $1.5\times10^{-3}$ | 0.05 | A | 98 | 0.85 | 2.85 | A |
| 2-15 | 3-1 | $3.0\times10^{-3}$ | 0.1 | A | 98 | 0.85 | 2.83 | A |
| 2-16 | 3-1 | $6.0\times10^{-3}$ | 0.2 | B | 97 | 0.86 | 2.81 | A |
| 2-17 | 3-1 | $1.5\times10^{-2}$ | 0.5 | B | 96 | 0.87 | 2.74 | B |
| 2-18 | 3-9 | $3.0\times10^{-5}$ | 0.001 | B | 93 | 0.90 | 2.80 | B |
| 2-19 | 3-9 | $6.0\times10^{-5}$ | 0.002 | A | 94 | 0.88 | 2.83 | B |
| 2-20 | 3-9 | $1.5\times10^{-4}$ | 0.005 | A | 97 | 0.88 | 2.82 | B |
| 2-21 | 3-9 | $3.0\times10^{-4}$ | 0.01 | A | 98 | 0.85 | 2.85 | A |
| 2-22 | 3-9 | $1.5\times10^{-3}$ | 0.05 | A | 99 | 0.85 | 2.84 | A |
| 2-23 | 3-9 | $3.0\times10^{-3}$ | 0.1 | A | 98 | 0.85 | 2.83 | A |
| 2-24 | 3-9 | $6.0\times10^{-3}$ | 0.2 | B | 97 | 0.86 | 2.81 | A |

TABLE 2-continued

| Experiment No. | Compound | Content (mol/l) | Molar Ratio*1 | Replenisher Stability: Precipitation | Replenisher Stability: Residual CD-4 (%) | Running Performance: DminY | Running Performance: DmaxY | Running Performance: Staining |
|---|---|---|---|---|---|---|---|---|
| 2-25 | 3-9 | $1.5\times10^{-2}$ | 0.5 | B | 97 | 0.87 | 2.76 | B |
| 2-26 | 3-17 | $3.0\times10^{-5}$ | 0.001 | B | 92 | 0.90 | 2.80 | B |
| 2-27 | 3-17 | $6.0\times10^{-5}$ | 0.002 | A | 95 | 0.88 | 2.84 | B |
| 2-28 | 3-17 | $1.5\times10^{-4}$ | 0.005 | A | 97 | 0.87 | 2.82 | B |
| 2-29 | 3-17 | $3.0\times10^{-4}$ | 0.01 | A | 98 | 0.85 | 2.85 | A |
| 2-30 | 3-17 | $1.5\times10^{-3}$ | 0.05 | A | 98 | 0.85 | 2.84 | A |
| 2-31 | 3-17 | $3.0\times10^{-3}$ | 0.1 | A | 98 | 0.85 | 2.83 | A |
| 2-32 | 3-17 | $6.0\times10^{-3}$ | 0.2 | B | 97 | 0.86 | 2.80 | A |
| 2-33 | 3-17 | $1.5\times10^{-2}$ | 0.5 | B | 96 | 0.87 | 2.74 | B |

*1molar ratio of compound of formula (2) or (3) to compound of formula (1)

As can be seen from Table 2, it was proved that containing compounds of formula (2) or (3) the developer composition led to further enhanced effects of the invention. It was also proved that the molar ratio of the compounds to the compound of formula (1) was preferably 0.01 to 0.1.

Example 3

Experiments were conducted similarly to Experiment No. 1-13 in Example 1, provided that the developer composition further contained compounds shown in Table 3 and aged in the incubator at 50° C. for 3 months. Results thereof are shown in Table 3.

TABLE 3

| Experiment No. | Compound | Content (g/l) | Replenisher Stability: Precipitation | Replenisher Stability: Residual CD-4 (%) | Running Performance: DminY | Running Performance: DmaxY | Running Performance: Staining |
|---|---|---|---|---|---|---|---|
| 3-1 | — | 0 | B | 92 | 0.91 | 2.81 | B |
| 3-2 | 4-1 | 10 | A | 93 | 0.90 | 2.80 | A |
| 3-3 | 4-1 | 20 | A | 94 | 0.91 | 2.79 | A |
| 3-4 | 4-2 | 10 | A | 92 | 0.92 | 2.76 | A |
| 3-5 | 4-2 | 20 | A | 93 | 0.91 | 2.77 | A |
| 3-6 | 4-8 | 10 | B | 91 | 0.90 | 2.75 | A |
| 3-7 | 4-9 | 10 | B | 92 | 0.90 | 2.74 | A |
| 3-8 | 4-10 | 10 | B | 92 | 0.91 | 2.74 | A |

As can be seen from Table 3, it was proved that the use of compounds of formula (4) led to preferable results.

Example 4

Experiments were conducted similarly to Experiment No. 1-13 in Example 1, provided that penta-sodium diethylenetriaminepentaacetate (also denoted as DTPA-Na) contained the developer composition was changed to compounds shown in Table 3 and the developer composition was aged in the incubator at 50° C. for 3 months. Results thereof are shown in Table 4.

TABLE 4

| Experiment No. | Compound | Replenisher Stability: Precipitation | Replenisher Stability: Residual CD-4 (%) | Running Performance: DminY | Running Performance: DmaxY | Running Performance: Staining |
|---|---|---|---|---|---|---|
| 4-1 | DTPA-Na | B | 92 | 0.91 | 2.81 | B |
| 4-2 | 5-1 | A | 91 | 0.90 | 2.82 | A |

TABLE 4-continued

| Experiment No. | Compound | Replenisher Stability: Precipitation | Replenisher Stability: Residual CD-4 (%) | Running Performance: DminY | Running Performance: DmaxY | Running Performance: Staining |
|---|---|---|---|---|---|---|
| 4-3 | 5-3 | A | 93 | 0.94 | 2.81 | A |
| 4-4 | 5-14 | A | 94 | 0.92 | 2.80 | A |
| 4-5 | 6-1 | A | 92 | 0.93 | 2.81 | A |
| 4-6 | 6-2 | A | 94 | 0.91 | 2.84 | A |
| 4-7 | 6-6 | A | 91 | 0.92 | 2.79 | A |
| 4-8 | 7-2 | A | 90 | 0.90 | 2.81 | A |
| 4-9 | 7-11 | A | 91 | 0.89 | 2.77 | A |
| 4-10 | 7-13 | A | 93 | 0.90 | 2.81 | A |

As apparent from Table 4, it was proved that the use of chelating agents represented by formula (5) through (7) was preferable to enhance effects of the invention.

Example 5

A concentrated color developer composition was prepared according to the following formula:

| | |
|---|---|
| Sodium sulfite | 0.05 mol |
| Potassium carbonate | 80 g |
| Sodium diethylenetriaminepentaacetate | 10 g |
| Potassium bromide | 0.5 g |
| Compound 1-18 | 0.05 mol |
| Color developing agent, as shown in Table 5 | |
| pH | 10.30 |

Water was added to make a total volume of 1 liter and the pH was adjusted with 50% sulfuric acid or potassium hydroxide.

The thus prepared composition was put into a hermetically sealed container and aged in the incubator at 50° C. for 2 months. A part of the developer composition was diluted two times with water to prepare a color developer replenishing solution. The replenishing solution was put into a polyethylene vessel having an open top area ratio of 0.15 $cm^{-1}$. and having been aged for one month in the incubator maintained at 30° C. The residual developer composition was also put into a polyethylene vessel having an open top area ratio of 0.15 $cm^{-1}$. and having been aged for one month in the incubator maintained at 30° C. After being aged, precipitation onto walls of the container and the residual content of the color developing agent (expressed in were measured. Results thereof are shown in Table 5.

TABLE 5

| Experiment No. | Color Developing Agent (mol/l) | Replenisher Stability Precipitation | Residual Content (%) |
|---|---|---|---|
| 5-1 | CD-4 (0.03) | B | 93 |
| 5-2 | CD-4 (0.05) | B | 92 |
| 5-3 | CD-4 (0.07) | B | 90 |
| 5-4 | CD-3 (0.03) | B | 89 |
| 5-5 | CD-3 (0.05) | B-C | 87 |
| 5-6 | CD-3 (0.07) | B-C | 85 |

In Table 5, CD-3 refers to exemplified color developing agent (1) described earlier. As can be seen from Table 5, CD-4 is preferred as a color developing agent used in the invention.

Example 6

A concentrated color developer composition was prepared according to the following formula:

| | |
|---|---|
| Sodium sulfite | 0.05 mol |
| Potassium carbonate | 80 g |
| Sodium diethylenetriaminepentaacetate | 10 g |
| Potassium bromide | 0.5 g |
| Compound 1-18 | 0.05 mol |
| CD-4 | 0.05 mol |
| pH | 10.30 |

Water was added to make a total volume of 1 liter and the pH was adjusted with 50% sulfuric acid or potassium hydroxide.

The thus prepared composition was put into a hermetically sealed container and aged in the incubator at 50° C. for 2 months. A part of the developer composition was diluted two times with water to prepare a color developer replenishing solution. The replenishing solution was put into a polyethylene vessel having an open top area ratio of 0.15 $cm^{-1}$. and having been aged for one month in the incubator maintained at 30° C. The residual developer composition was also put into a polyethylene vessel having an open top area ratio of 0.15 $cm^{-1}$. and having been aged for one month in the incubator maintained at 30° C.

After being aged, processing photographic material using the aged replenishing solution and the aged developer composition, evaluation was made with respect to running performance. The evaluation of running performance was conducted similarly to Example 1, using an automatic processor, in which processor KP-46QA (produced by Konica Corp.) was modified so that in addition to the replenishing solution, water was also replenished to the developing tank. In the color developing step, the replenishing rate is as follow:

| Expt. No. | Replenisher | Replenishing rate |
|---|---|---|
| 6-1 | Replenishing solution | 500 ml/$m^2$ |
| 6-2 | Composition/water | 250 ml/$m^2$ (Composition)<br>250 ml/$m^2$ (Water) |

Upon completion of running process, photographic material (Konica Color CENTURIA 400), exposed through an optical wedge was processed and yellow densities were measured with respect to minimum and maximum density areas (DminY, DmaxY). At the start of running process on the final day, the extent of staining onto the surface of processed film was evaluated. Results are shown in Table 5.

TABLE 6

| Experiment No. | Running Performance DminY | DmaxY | Staining |
|---|---|---|---|
| 6-1 | 0.91 | 2.82 | B |
| 6-2 | 0.90 | 2.82 | A |

As can be seen from Table 6, it was proved that directly replenishing the concentrated color developer composition into the developing tank of the processor also resulted enhanced effects of the invention.

What is claimed is:

1. A concentrated color developer composition comprising:

a color developing agent, a sulfite, a compound represented by formula (1), a compound represented by formula (2) or (3), and a compound represented by formula (4), and the color developing agent has a concentration of 0.02 to 0.2 mol/l, the sulfite has a concentration meeting the following requirement:

0.1<sulfite concentration (mol/l)/color developing agent concentration (mol/l)<10, the compound of formula (2) or (3) has a molar ratio of the compound of formula (2) or (3) to the compound of formula (1) of 0.01 to 0.1, and the compound of formula (4) is present in an amount of 1 to 50 g/l, $$HO—N—(X\text{-}A)_2 \qquad \text{formula (1)}$$

wherein X is an alkylene group, which may be substituted; A is a carboxyl group, sulfo group, phosphono group, hydroxy group, alkoxy group, amino group, ammonio group, sulfamoyl group or sulfamoyl group, $$HO—NH—X\text{-}A \qquad \text{formula (2)}$$

$$Y—R—SO_3M \qquad \text{formula (3)}$$

wherein X and A are the same as defined in formula (1); Y is a hydroxy group, a halogen atom, an alkoxy group, a sulfo group or a sulfonate group, a sulfuric ester group or sulfate ester, or a sulfonyl halide; R is an alkylene group having 1 to 5 carbon atoms; M is Li, Na, K or $NH_4$, $$HO—(R—O)_n—H \qquad \text{formula (4)}$$

wherein R is $—CH_2—CH_2—$, $—CH_2—CH_2—CH_2—$, or $—CH_2—CH(CH_3)—$; and n is an integer of 1 to 30.

2. The concentrated color developer composition of claim 1, wherein the compound represented by formula (1) is contained in concentration of 0.01 to 0.1 mol/l.

3. The concentrated color developer composition of claim 1, wherein the composition further comprises a compound represented by formula (5) through (7):

formula (5)

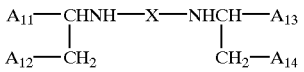

wherein $A_{11}$, $A_{12}$, $A_{13}$, and $A_{14}$ are each $—CH_2OH$, $—PO_3(M_6)_2$ or $—COOM_7$, in which $M_6$ and $M_7$ are each a hydrogen atom, ammonium group, an alkali metal atom or organic ammonium group; X is an alkylene group having 2 to 6 carbon atoms or $—(B_1O)_n—B_2—$, in which n is an integer of 1 to 6 and $B_1$ and $B_2$ are each an alkylene group having 1 to 6 carbon atoms;

formula (6)

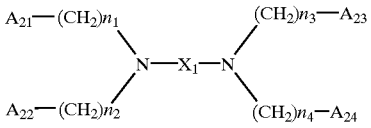

wherein $A_{21}$, $A_{22}$, $A_{23}$, and $A_{24}$ are each $—CH_2OH$, $—COOM^1$ or $—PO_3(M^2)_2$, in which $M^1$ and $M^2$ are each a hydrogen atom, ammonium group, an alkali metal atom or organic ammonium group; $X_1$ is an alkylene group having 2 to 6 carbon atoms, a saturated or unsaturated cyclic organic group or $—(B_{11}O)_{n5}—B_{12}—$, in which n5 is an integer of 1 to 6, and $B_{11}$ and $B_{12}$ are an alkylene group having 1 to 5 carbon atoms; n1, n2, n3 and n4 are each an integer of 1 or more, provided that at least one of n1, n2, n3 and n4 is 2 or more;

formula (7)

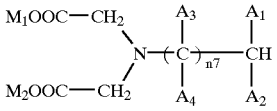

wherein $A_1$, $A_2$, $A_3$, and $A_4$ are a hydrogen atom, a hydroxy group, $—COOM_3$, $—PO_3(M_4)_2$, $—CH_2COOM_5$, $—CH_2OH$ or a lower alkyl group, provided that at least one of $A_1$, $A_2$, $A_3$, and $A_4$ is $—COOM_3$, $—PO_3(M_4)_2$, or $—CH_2COOM_5$; $M_1$, $M_2$, $M_3$, $M_4$ and $M_5$ are each a hydrogen atom, ammonium group, alkali metal atom or organic ammonium group; n7 is 0, 1 or 2.

4. The concentrated color developer composition of claim 1, wherein the color developing agent is a N-hydroxyalkyl-substituted p-phenylenediamine type color developing agent.

5. A method for processing a silver halide color photographic material using an automatic processor, the method comprising:

exposing the photographic material and developing the exposed photographic material in a developing tank, wherein the method further comprises replenishing a replenisher solution to the developing tank, wherein the replenisher solution is a concentrated color developer composition as claimed in claim 1.

6. The method of claim 5, wherein the method further comprises replenishing water to the developing tank.

7. A concentrated color developer composition comprising:

a color developing agent, a sulfite, a compound represented by formula (1), a compound represented by formula (2) or (3), and a compound represented by formula (4), and the color developing agent has a concentration of 0.01 to 0.2 mol/l, the sulfite has a concentration meeting the following requirement:

0.1<sulfite concentration (mol/l)/color developing agent concentration (mol/l)<10, the compound represented by formula (1) is present in a concentration of 0.01 to 0.1 mol/l, the compound of formula (2) or (3) has a molar ratio of the compound of formula (2) or (3) to the compound of formula (1) of 0.01 to 0.1, and the compound of formula (4) is present in an amount of 1 to 50 g/l, $$HO—N—(X\text{-}A)_2 \qquad \text{formula (1)}$$

wherein X is an alkylene group, which may be substituted; A is a carboxyl group, sulfo group, phosphono group, hydroxy group, alkoxy group, amino group, ammonic group, sulfamoyl group or sulfamoyl group, $$HO—NH—X\text{-}A \qquad \text{formula (2)}$$

$$Y—R—SO_3M \qquad \text{formula (3)}$$

wherein X and A are the same as defined in formula (1); Y is a hydroxy group, a halogen atom, an alkoxy group, a sulfo group or a sulfonate group, a sulfuric ester group or sulfate ester, or a sulfonyl halide; R is an alkylene group having 1 to 5 carbon atoms; M is Li, Na, K or $NH_4$, $$HO—(R—O)_n—H \qquad \text{formula (4)}$$

wherein R is $—CH_2—CH_2—$, $—CH_2—CH_2—CH_2—$, or $—CH_2—CH(CH_3)—$; and n is an integer of 1 to 30.

8. A color developer solution made by diluting a concentrated color developer composition as claimed in claim 7.

9. A color developer replenishing solution made by diluting a concentrated color developer composition as claimed in claim 7.

* * * * *